United States Patent [19]

Tomita et al.

[11] Patent Number: 4,545,580

[45] Date of Patent: Oct. 8, 1985

[54] WOOD-TYPE GOLF CLUB HEAD

[75] Inventors: Osamu Tomita; Yoshihiko Murase; Seiya Nishimura, all of Shizuoka, Japan

[73] Assignee: Nippon Gakki Seizo Kabushiki Kaisha, Japan

[21] Appl. No.: 580,109

[22] Filed: Feb. 14, 1984

[30] Foreign Application Priority Data

Feb. 15, 1983 [JP] Japan ..... 58-023194
Apr. 22, 1983 [JP] Japan ..... 58-071075

[51] Int. Cl.[4] ..... A63B 53/04
[52] U.S. Cl. ..... 273/167 R; 273/80 C
[58] Field of Search ..... 273/80.2, 80.3, 167 R, 273/167 F, 167 H, 169, 82 R

[56] References Cited

U.S. PATENT DOCUMENTS 2,534,947 12/1950 Bright ..... 273/167 F
3,397,889 8/1968 Smith ..... 273/82 R

*Primary Examiner*—Richard C. Pinkham
*Assistant Examiner*—Vincent A. Mosconi
*Attorney, Agent, or Firm*—Lerner, David, Littenberg, Krumholz & Mentlik

[57] ABSTRACT

A wood-type golf club head containing a fiber reinforced plastic outer shell formed by heat pressing in a mould, around an intermediate shell. A solid center core is formed inside the intermediate shell by injection of foam synthetic resin for reduced generation of harsh and keen noises at hitting balls, ideal transmission of striking energy to balls and high durability against shocks by hitting balls. The elastic modulus of the outer shell material is greater than that of the intermediate shell material. The buckling strength of the intermediate shell material is greater than that of the foam resin core material.

3 Claims, 6 Drawing Figures

WOOD-TYPE GOLF CLUB HEAD

BACKGROUND OF THE INVENTION

The present invention relates to an improved wood-type golf club head, and more particularly relates to improvements in construction and production of a wood-type golf club head including a shell made of fiber reinforced plastics.

One example of a wood-type golf club head including a shell made of fiber reinforced plastics is disclosed in Japanese Patent Publication No. sho. 51-21436. This golf club head includes a convitious shell made of fiber reinforced plastics and a synthetic resin core filled in the cavity of the shell. In production of this golf club head a foam synthetic resin crude core is first formed into the shape of the core, the shaped crude core is next covered, mostly manually, with a crude shell made of fiber reinforced plastics in order to form a crude golf club head, and the crude golf head is then encased within a proper mould for subsequent heating.

In the case of the above-described production process, however, troubles tend to start when there is any gap between the capacity of the mould cavity and the volume of the crude golf club head. Since formation of the crude shell on the crude core is usually carried out by manual operation, it is difficult to constantly set the volume of the crude golf club head to a correct value. As a consequence, unavoidable variation in volume of the crude golf club head produces the above-described gap. Presence of such a gap between the capacity of the mould cavity and the volume of the crude club head develops variation in pressure to be applied to the crude golf club head placed in the cavity of the mould at mould fastening. When the fiber reinforced plastic crude shell is made up of several super-imposed layers, insufficient pressure tends to connect to poor inter-layer combination and development of voids between the layers and/or on the surface of the produced golf club head. Excessive pressure pushes some of the crude shell into gaps between mating surfaces of mould pieces at mould fastening to produce undesirable projections or flashes on the surface of the produced golf club head. For better appearance of the product, these flashes have to be removed after moulding of the golf club head. Such removal tends to deteriorate the quality of the product and, in worst cases, destroys fibers in the fiber reinforced plastic shell whilst lowering the strength of the entire golf club head.

In order to make up for the above-described disadvantage inherent to the conventional process, a new process of production was proposed in U.S. patent application Ser. No. 516,800 filed on 25th July, 1983, now abandoned. In the process of this prior proposal, a cavitious crude core is made of thermoplastic synthetic resin, the crude core is next covered with a crude shell made of fiber reinforced plastics to form a crude golf club head, and the crude golf club head is then subjected to heat pressing in a mould in order to press the crude shell against the mould cavity wall via inflation of the crude core. This inflation of the crude core at head pressing is caused either by thermal expansion of air initially confined in the crude core or by later introduction of pressurized medium into the crude core placed in the mould cavity.

In the case of a golf club head produced by this proposed process, the crude core is pressed against the crude shell due to its own inflation and the core in the produced golf club head is cavitious in construction. In other words, there is nothing else in the construction of the golf club head to press the core to the shell. Depending on the rate of inflation at heat pressing, there is a danger that, in the construction of the produced golf club head, the core is poorly bound to the fiber reinforced plastic shell. Such poor binding tends to allow separation of the core from the shell at hitting of balls by the golf club head. When a golf club is swung under such a separated condition of the components, impulsive touch and impingement of the core with the fiber reinforced plastic shell generates harsh noises which get on user's nerves greatly and, as a consequence, lower the commercial value of the product.

In addition to such a separation problem resulted from ill production, the cavitious construction of the produced golf club head has its own demerits. Due to shock at hitting balls, elastic deformation of the cavitious construction is liable to generate vibrations in the fiber reinforced plastic core which bar smooth transmission of striking energy to balls, thereby significantly decreasing the distance of flight. Further, keen sounds are generated at hitting balls. In addition, regional concentration of shock at hitting ball tends to occur during its transmission through the face side section of the fiber reinforced plastic shell. When the core is made of foam synthetic resins which is in general fragile and poor in buckling strength, the above-described shock concentration causes development of fine cracks in the peripheral section of the core, thereby lowering durability of the golf club head.

SUMMARY OF THE INVENTION

It is one object of the present invention to produce a wood-type golf club head including a fiber reinforced plastic shell which is free of generation of harsh and/or keen noises at hitting balls.

It is another object of the present invention to produce a wood-type gold club head including a fiber reinforced plastic shell which assures ideal transmission of striking energy to balls at hitting.

It is the other object of the present invention to provide a wood-type golf club head which is highly durable against shocks at hitting balls.

In accordance with one aspect of the present invention, a center core made of foam synthetic resin is wholly embraced by and strongly bound to an intermediate shell made of thermoplastic resin, and the intermediate shell is wholly embraced by and strongly bound to an outer shell made of fiber reinforced plastics.

In accordance with another aspect of the present invention, a cavitious intermediate shell is first formed from thermoplastic resin, the intermediate shell is then covered with a crude outer shell made of fiber reinforced plastics to form a crude, incomplete golf club head which is then placed in position in a proper mould, and the crude, incomplete golf club head is then subjected to heat pressing in the mould at a temperature to cause softening and inflation of said crude intermediate shell, thereby producing an incomplete golf club head having an outer shell and an intermediate shell. Formable synthetic resin is injected into a cavity formed by the intermediate shell and the injected synthetic resin is foamed.

DESCRIPTION OF THE PREFERRED EMBODIMENT

Figure 1:
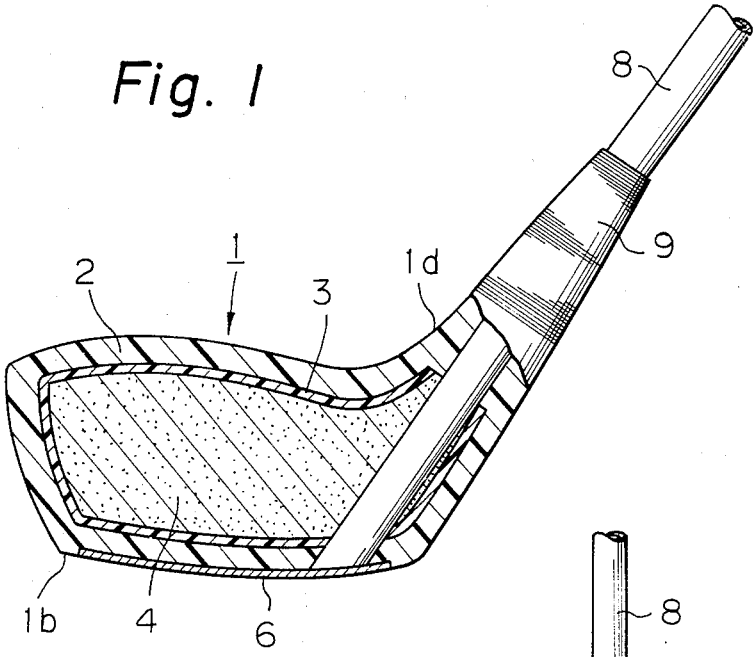
FIG. 1 is a side view, partly in section, of one embodiment of the wood-type golf club head in accordance with the present invention.
Figure 2:
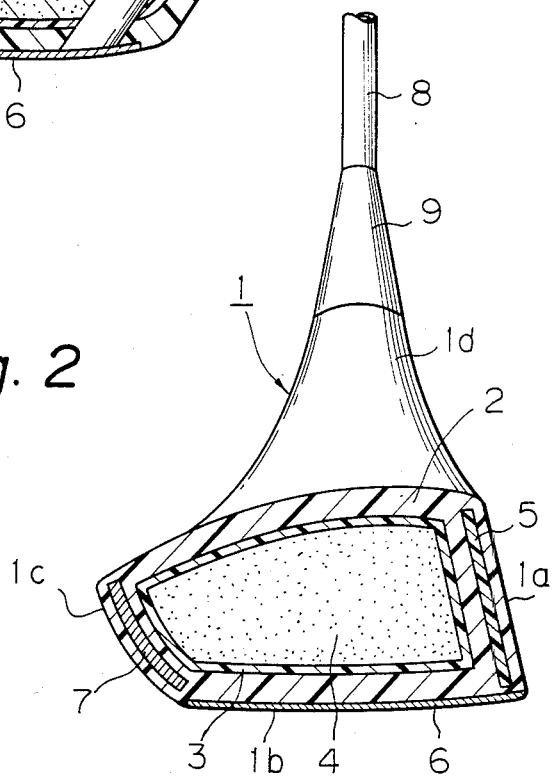
FIG. 2 is a perspective view, partly in section, of the golf club head shown in FIG. 1, FIGS. 3 and 4 are side views, partly in section, for showing operational steps in one embodiment of the method in accordance with the present invention.

One embodiment of the wood-type golf club head is shown in FIGS. 1 and 2, in which a golf club head 1 is made up of an outer shell 2 made of fiber reinforced plastics, an intermediate shell 3 made of thermoplastic resin which is fully embraced by and strongly bound to the outer shell 2, and a center core 4 made of foam synthetic resin which is wholly embraced by and strongly bound to the intermediate shell 3. The configuration of the golf club head 1 is defined by a face side 1*a*, a sole side 1*b*, a back side 1*c* and a neck section 1*d*. The face 1*a* includes a face plate 5 which is in general made of hardened plastics reinforced by carbon fibers. The sole side 1*b* is covered with a sole plate 6 made of metal such as brass. Likewise, a back plate 7 made of metal is embedded in the back side 1*c* when required. A club shaft 8 extends through and is fixed to the neck section 1*d* by assistance of a protector 9.

As described above, the outer shell 2 is in general made of fiber reinforced plastics. More specifically, the outer shell 2 is preferably made of epoxide resins or unsaturated polyester resins. Carbon fibers including graphite fibers are majorly used for fortification while glass fibers and Kevlar may be added when required. These fortifier fibers are in general given in the form of a sheet including 5 to 12 layers of hollow cloths. The sheet preferably contains about 96 bunches of fibers, each bunch containing about 6,000 fibers. The thickness of the sheet is in a range from 3 to 10 mm., and more preferably in a range from 4 to 7 mm. Different designs of fortification should preferably be employed for the neck section 1*d* the top section, and the face side 1*a* of the golf club head. For the neck section, for example, a different hollow cloth sheet may be used which cotains about 32 bunches of fibers, each bunch containing about 3000 fibers. In this case, the hollow cloth sheet is arranged so that fringes of the cloth should partly overlap with each other. A sheet including 2 to 3 layers of satin weave cloths may preferably be used for the top section with a thickness in a range from 0.4 to 1.0 mm for surface smoothness of the product and better shapeability during production. A sheet including 5 to 15 layers of twist yarn or roving cloths ay preferably be used for the face side 1*a* with a thickness in a range from 3 to 8 mm.

The intermediate shell 3 is in general made of thermoplastic resin. More specifically, the intermediate shell 3 is made of a synthetic resin such as polyvinyl chloride resin which has an elastic modulus smaller that of the carbon fiber reinforced plastics used for the outer shell 2, and more preferably larger than that of the foam synthetic resin used for the center core 4. The synthetic resin for the intermediate shell 3 should further preferably have a buckling strength larger than that of the foam synthetic resin used for the center core 4.

The center core 4 is in general made of foam synthetic resin such as foam polyurethane resin.

One example of the process in accordance with the present invention will next be explained in reference to FIGS. 3 and 4.

In production of the golf club head in accordance with the present invention, a cavitious, crude intermediate shell 13 is first formed from thermoplastic resin by, for example, blow shaping. The crude intermediate shell 13 is similar in shape to but a little smaller in size than the intermediate shell 3 in the end product. When required, a proper fluid such as air is confined in the cavity of the crude intermediate shell 13 in order to keep its shape during the subsequent process of production.

Figure 3:
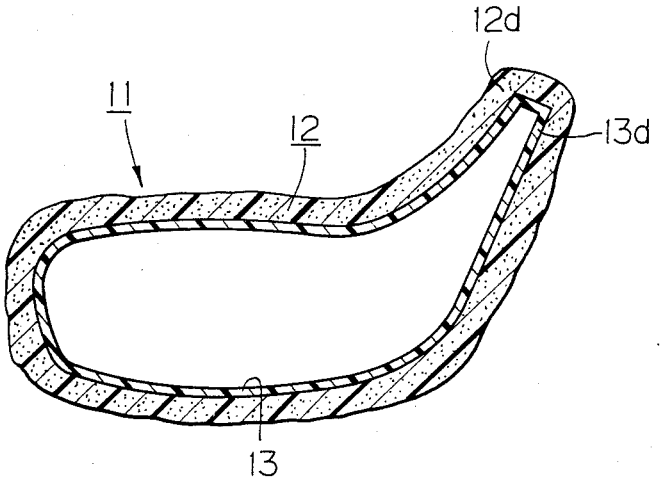
Figure 4:
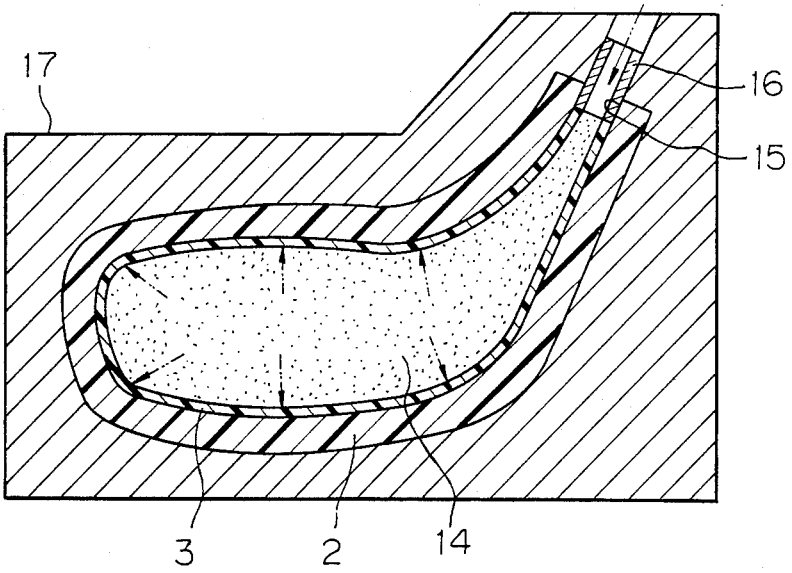

Next, as shown in FIG. 3, the crude intermediate shell 13 is covered, for example by hand smearing, with a crude outer shell 12 made of fiber reinforced plastics to form a crude incomplete golf club head 11. An injection hole 15 is formed through neck sections 12*d* and 13*d* of the crude outer shell 12 and the crude intermediate shell 13 and a mouth piece 16 is fitted to the injection hole 15.

The crude incomplete golf club head 11 is then placed in position in the cavity of a mould 17. The mould cavity has a shape and size of the golf club head 1 to be finally produced. Heating of the crude incomplete golf club head is carried out either by heating itself or by introducing hot fluid of 60° to 150° C. into the cavity defined by the crude intermediate shell 13. This heating in the mould 17 causes softening of the crude intermediate shell. Concurrently with this heating, pressurized medium such as compressed air, steam or pressure oil is introduced into the cavity of the intermediate shell 13 via the mouth piece 16 in order to cause inflation of the intermediate shell 13. The pressure of the medium should preferably be in a range from 5 to 15 $Kg/cm^2$. This inflation of the intermediate shell 13 strongly presses the outer shell 12 against the cavity wall of the mould 17.

After the heat pressing is over, the pressurized medium is discharged and foamable synthetic resin 14 is injected into the cavity formed by the intermediate shell 3. By foaming the injected resin 14, a golf club head such as shown in FIGS. 1 and 2 is obtained.

When compressed air is used for inflation of the crude intermediate shell 13, use of preheated, hot compressed air can cause concurrent softening and inflation of the crude intermediate shell 13 without advanced heating of the latter. Use of steam for the pressurized medium is more advantageous from this point of view.

EXAMPLE

The crude outer shell was given in the form of a sheet made up of 7 layers of hollow cloths and 2 layers of satin weave cloths. The sheet included 96 bunches of fibers, each bunch containing 6000 fibers. The sheet was impregnated with epoxide resin solution and hardened. The intermediate shell was given in the form of a polyvinyl chloride resin sheet of 0.5 mm. thickness. The shells were combined with each other so that the outer shell covered the intermediate shell. This sample without a center core was used as an example of the conventional golf club head. Next, the center cavity of the above-described golf club head was filled with foam urethane resin. This sample was used as an example of the golf club head in accordance with the present invention.

Figure 5:
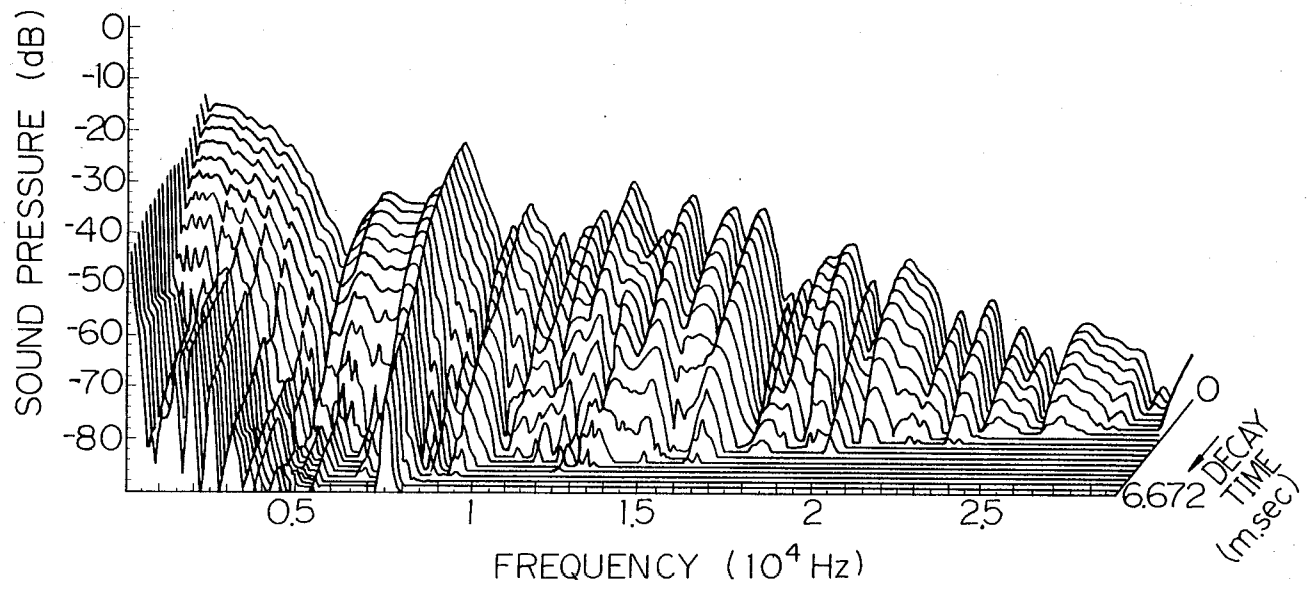
FIG. 5 is a graph for showing the relationship between sound pressure and sound decay time at various frequencies for a golf club head without a center core.
Figure 6:
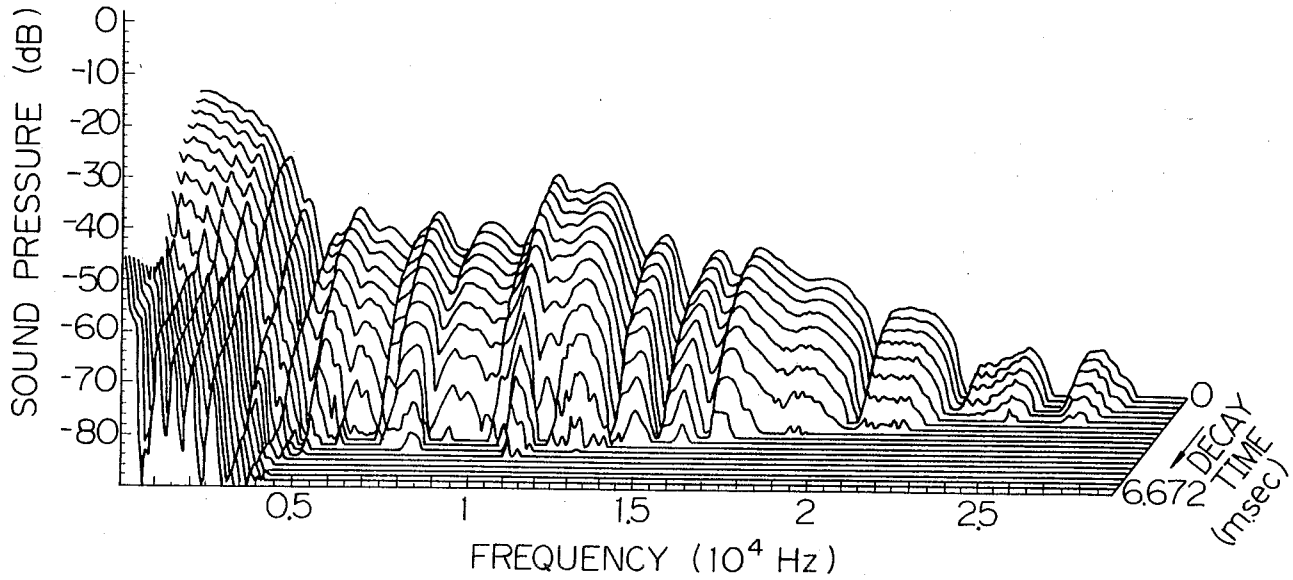
FIG. 6 is a graph for showing the relationship between sound pressure and sound decay time at various frequencies for a golf club head in accordance with the present invention.

The two sorts of samples were subjected to measurement of the relationship between sound pressure and sound decay time at various frequencies. The results are shown in FIGS. 5 and 6. In the graphs, frequencies in Hz are taken on the abscissa, sound pressure in dB. is taken on the left ordinate and decay time in m.sec. is taken on the right inclined ordinate.

FIG. 5 is for the conventional golf club head and FIG. 6 is for the golf club head in accordance with the present invention. It is learned from FIG. 5 that lots of sound pressure peaks appear over the entire audible range of frequencies and, in particular in the higher range of frequencies. Presence of such peaks indicates that the conventional golf club head generates a great deal of harsh and keen noises at hitting balls. In contrast to this, the graph in FIG. 6 contains less number of sound pressure peaks over the entire audible range of frequencies and, in particular in the higher range of frequencies. It is clear from this that the golf club head in accordance with the present invention is quite free of harsh and keen noise at hitting balls. Faster decay in sound further prevents long presence of uncomfortable sound even once generated. Proper choice in density and pressure at injection of the foam synthetic resin for the center core enables subtle adjustment in weight of the golf club head and mode of sound generation at hitting balls.

We claim:

1. An improved wood-type gold club head comprising an outer shell made of fiber reinforced plastics, an intermediate shell made of thermoplastic resin which is wholly embraced by and strongly bonded to said outer shell, and a center core made of foam synthetic resin which is wholly embraced by and strongly bonded to said intermediate shell, the elastic modulus of said thermoplastic resin used for said intermediate shell being smallar than that of said fiber reinforced plastics used for said outer shell and the buckling strength of said thermoplastic resin used for said intermediate shell being larger than that of said foam synthetic resin used for said center core.

2. An improved wood-type golf head club as claimed in claim 1 in which said outer shell includes a textile sheet whose thickness is in a range from 3 to 10 mm.

3. An improved wood-type golf club head as claimed in claim 1 in which said thermoplastic resin for said intermediate shell has an elastic modulus which is larger than that of said foam synthetic resin for said center core.

* * * * *

UNITED STATES PATENT AND TRADEMARK OFFICE

CERTIFICATE OF CORRECTION

PATENT NO. : 4,545,580

DATED : October 8, 1985

INVENTOR(S) : Tomita, et al.

It is certified that error appears in the above-identified patent and that said Letters Patent is hereby corrected as shown below:

Column 1, line 20, after "golf" insert --club--.
Column 1, line 32, after "crude" insert --golf--.
Column 3, line 54, "cotains" should read --contains--.
Column 3, line 68, after "smaller" insert --than--.
Column 6, line 5, "gold" should read --golf--.

Signed and Sealed this

*Twenty-first* Day of *January 1986*

[SEAL]

*Attest:*

DONALD J. QUIGG

*Attesting Officer*

*Commissioner of Patents and Trademarks*